United States Patent [19]

Katchka et al.

[11] 4,142,169

[45] Feb. 27, 1979

[54] SOLENOID AND METHOD OF MANUFACTURE

[75] Inventors: Jay R. Katchka, Cypress; Samuel T. Kelly, Torrance, both of Calif.

[73] Assignee: Robertshaw Controls Company, Richmond, Va.

[21] Appl. No.: 816,656

[22] Filed: Jul. 18, 1977

[51] Int. Cl.[2] ..... H01F 7/10

[52] U.S. Cl. ..... 335/243; 335/245; 335/251

[58] Field of Search ..... 335/251, 258, 243, 244, 335/245, 249, 99, 231, 239; 361/206

[56] References Cited

U.S. PATENT DOCUMENTS

| | | | |
|---|---|---|---|
| 2,651,744 | 9/1953 | Acklin et al. | 335/251 |
| 3,134,932 | 5/1964 | Ray | 335/251 |
| 3,378,732 | 4/1968 | Dietz et al. | 335/251 |
| 3,805,204 | 4/1974 | Petersen | 335/258 |

*Primary Examiner*—Harold Broome

*Attorney, Agent, or Firm*—Fulwider, Patton, Rieber, Lee & Utecht

[57] ABSTRACT

There is disclosed a solenoid of improved construction and a facile method for its manufacture. The solenoid is intended for use with cyclic voltage supplies and has a fixed-position pole assembly of a pole piece, shading ring and flux ring which is secured in a retaining sleeve. The pole piece has an annular groove which receives an inward, annular bead of the sleeve to retain the assembly. The sleeve is mounted within a solenoid casing within an annular coil and the casing is closed by an end closure plate which bears against the end of the sleeve. The inward annular offset of the sleeve provides a resilient axial compressability of the sleeve permitting facile assembly to precise tolerances.

6 Claims, 11 Drawing Figures

FIG. 1
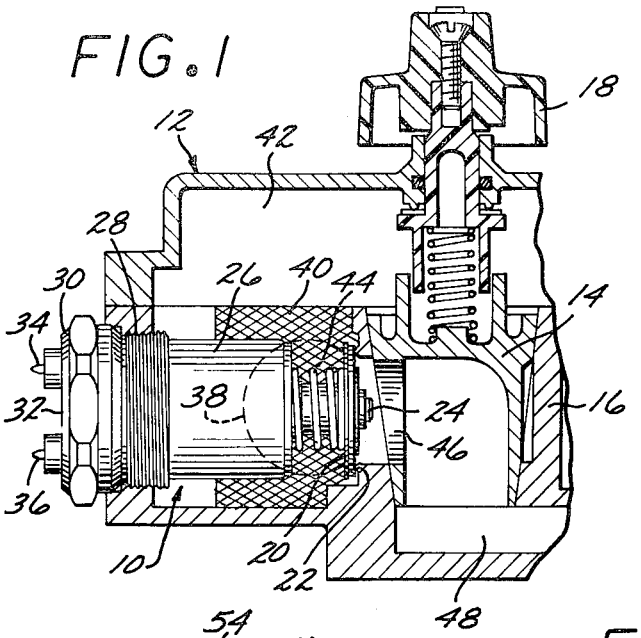
FIG. 3
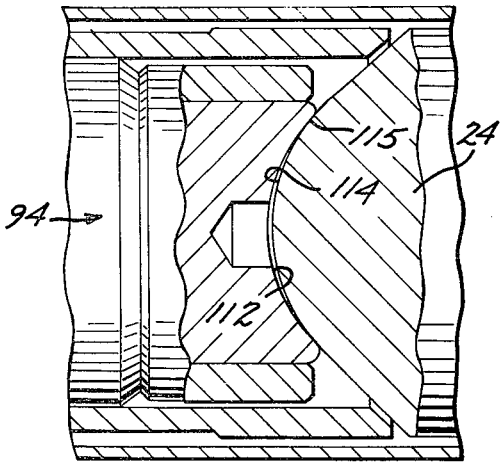
FIG. 2
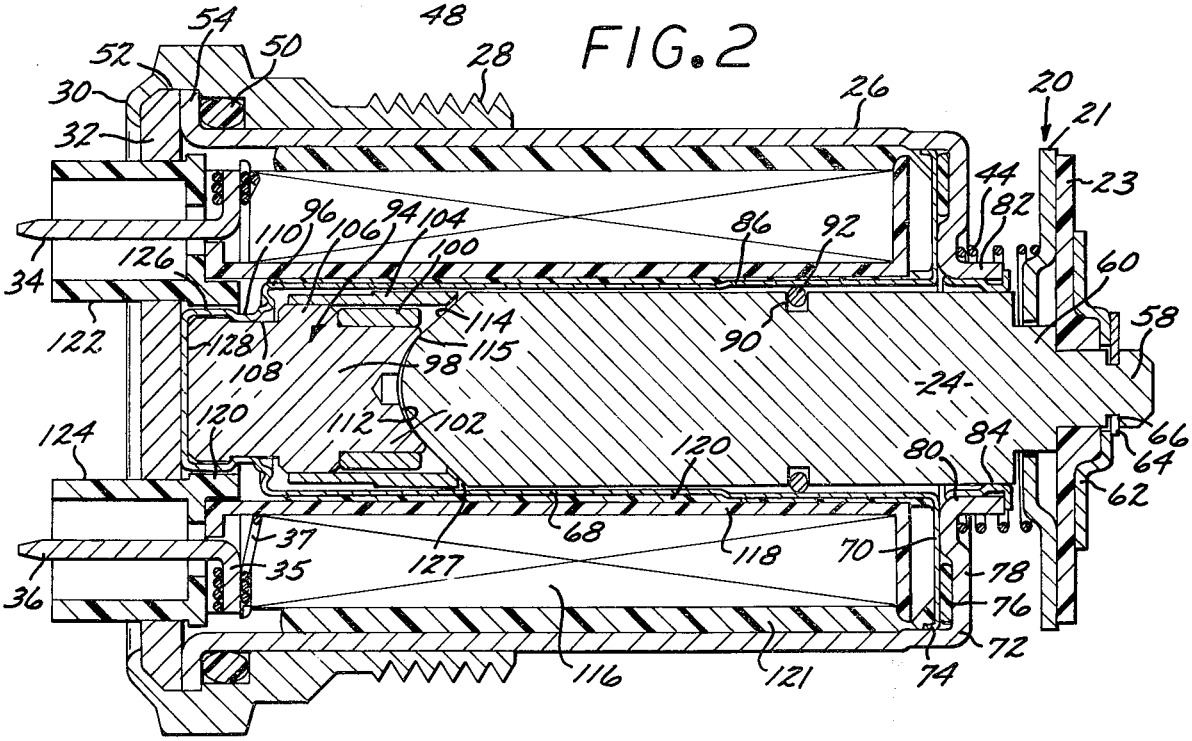
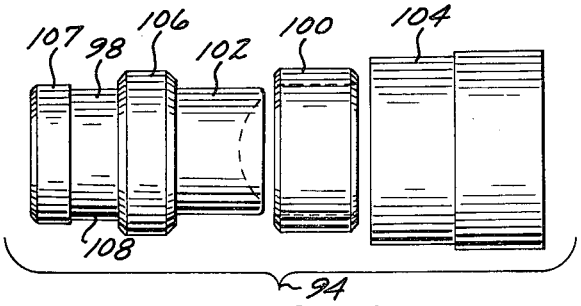
FIG. 4
FIG. 5
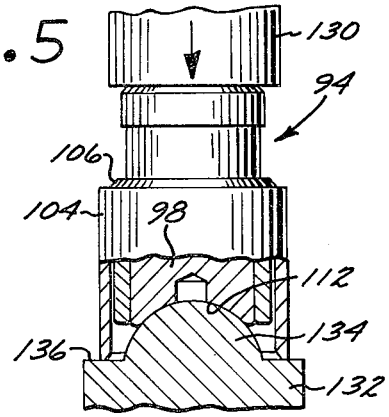

FIG. 6
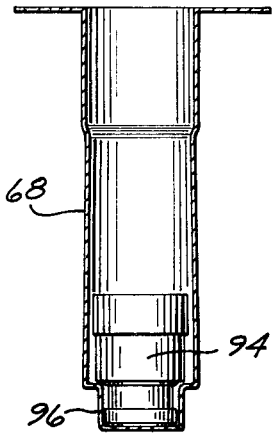
FIG. 7
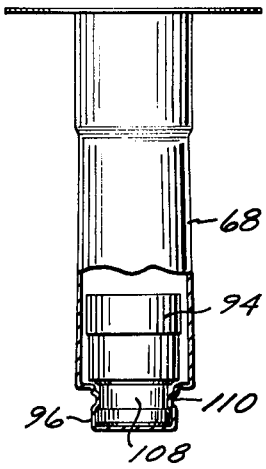
FIG. 8
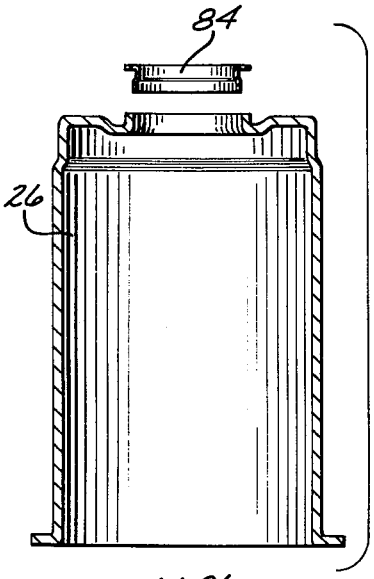
FIG. 9
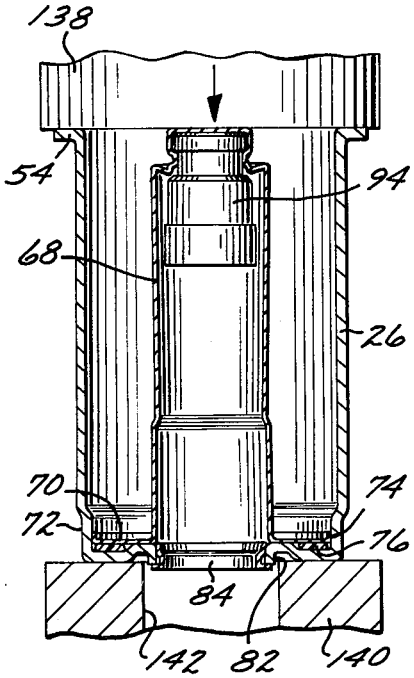
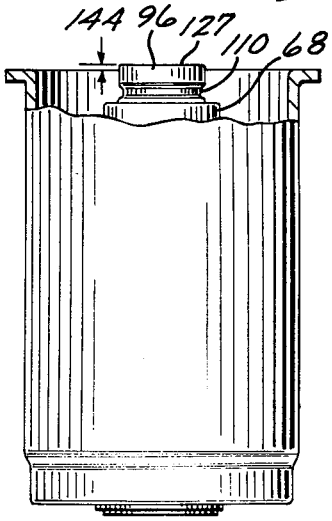
FIG. 10
FIG. 11
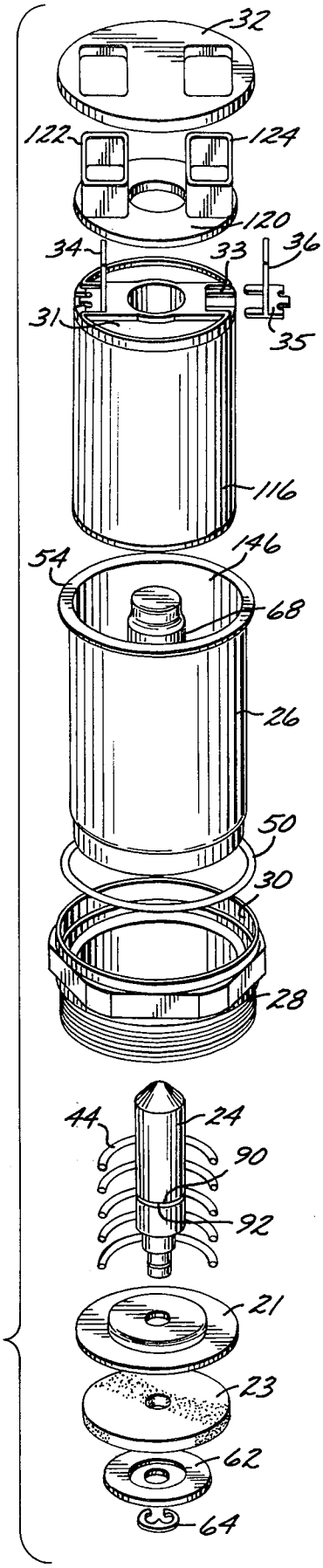

SOLENOID AND METHOD OF MANUFACTURE

BACKGROUND OF THE INVENTION

1. Field of the Invention

This invention relates to a solenoid of improved construction and to a method for its assembly.

2. Brief Description of the Prior Art

Solenoids intended for use with cyclic voltage supplies have employed a shading ring construction to eliminate noise or chatter caused by bouncing of the armature on the stationary pole during the cyclic variation of the supply voltage. This construction has generally employed a stationary pole piece, a concentric shading ring of an electrically conductive metal and a surrounding, concentric flux ring which is separated by a narrow air gap from the moveable armature when the latter is at its withdrawn position against the fixed pole assembly. The success of this construction critically depends on the spacing of the air gap and prior solenoid manufacturing methods have required precise machining of the stationary pole assembly and the precise positioning of the assembly in the solenoid coil.

BRIEF STATEMENT OF THE INVENTION

This invention comprises a solenoid of improved construction and a facile method for its assembly. The solenoid employs a pole assembly of a pole piece, concentric shading ring and outer, concentric flux ring which press fitted into an assembly with the flux ring Seated using a die that has an annular shoulder abutment to locate the flux ring at a precise, predetermined axial position. The pole assembly is fixedly mounted in a sleeve by means of an annular groove about the pole piece receiving an inward, annular bead of the retainer sleeve which is rolled into the annular groove during its assembly. The retainer sleeve is compressible by means of an axially resilient offset segment and thereby it can be assembled into the outer solenoid casing by a press fit which permits the retainer sleeve to spring back and positively seat against the end closure plate of the solenoid casing.

BRIEF DESCRIPTION OF THE DRAWINGS

The invention will be described with reference to the figures of which:

FIG. 1 illustrates the solenoid of the invention in an application as a valve actuator;

FIG. 2 is a sectional view of the solenoid of the invention;

FIG. 3 is a sectional view of the mating ends of the armature and fixed pole assembly;

FIG. 4 is an exploded view of the fixed pole assembly;

FIG. 5 illustrates the step of assembly of the fixed pole assembly;

FIGS. 6 and 7 illustrate the steps of assembly of the fixed pole and retainer sleeve;

FIGS. 8–10 illustrate the assembly of the outer solenoid casing and retainer sleeve assembly; and FIG. 11 is an exploded view of the solenoid of the invention.

DESCRIPTION OF THE PREFERRED EMBODIMENTS

Referring now to FIG. 1, the solenoid 10 of the invention is shown in its intended application as a valve operator for a unitary control device for main and pilot burner apparatus which is disclosed in greater detail in prior U.S. Pat. No. 3,592,225. The device 12 includes a plug valve member 14 mounted in a tapered valve seat 16 and actuated by a manual knob 18. This device is distinct from that disclosed in our prior patent in that the plug valve member 14 has only two settings; on and off, and operates independently of the position of the redundant valve 20. The latter valve member seats on a circular valve seat 22 and is secured to the end of the moveable armature 24 of the solenoid 10 of the invention. The solenoid 10 includes a cylindrical solenoid casing 26 received within a threaded sleeve 28 having a rolled edge 30 that secures a cover plate 32 and provides access openings for protruding terminal posts 34 and 36.

The gas supply to the regulating device 12 is through port 38, filter screen 40 and into the chamber 42 which is closed by valve closure member 20 that is resiliently biased into a closed registration with circular valve seat 22 by resilient coil spring 44. When the valve structure is open, under the influence of a voltage supply to terminal posts 34 and 36 with resultant movement of armature 24, gas is supplied to the plug valve member 14 and, when the latter is in its open position, through port 46 into flow passageway 48 leading to the succeeding portions of the regulator structure which are described in greater detail in the aforementioned prior patent.

Referring now to FIG. 2, the improved solenoid construction of this invention will be described in greater detail. As there illustrated, the solenoid assembly includes the aforementioned threaded sleeve 28 which is received over a tubular solenoid casing 26. The sleeve has an annular groove which receives sealing means such as O-ring 50 with a larger diameter annular groove 52 that receives an annular lip 54 of casing 26. The end of casing 26 is closed by cover plate 32 that is retained in the assembly by the edge 30 of sleeve 28 which is rolled about the upper peripheral edge of cover plate 32.

The moveable armature 24 has a shank 58 of a reduced diameter and an annular shoulder 60. The valve closure member 20 is received thereon and comprises a plate 21 received on the annular shoulder 60 and the valve facing disc 23 which is formed of a suitable gasket material. The valve member is secured by a retainer ring 62 and a clip ring such as a circlip and the like 64 that is seated in an annular groove 66 of shank 58. The armature is biased outwardly by resilient means in the form of compressive coil spring 44 that is retained between the end of the casing 26 and the valve plate 21.

The moveable armature 24 is received within cylindrical sleeve 68 which has an annular flange 70 that is press-fitted into the reduced diameter end 72 of casing 26 forming an upset annular rim 74. Seal means, in the form of a resilient washer 76, is compressed between the opposed faces of the end wall 78 of casing 26 and flange 70.

The end wall 78 of casing 26 has a through aperture 80 formed by a cylindrical wall 82 and receives a bushing 84 surrounding the projecting end of armature 25. The communicating end 86 of sleeve 68 is slightly enlarged, as shown, and the armature has an annular groove 90 in the region received within the enlarged end portion 86. A clip ring 92 is seated in groove 90 and functions with the enlarged end portion 86 and bushing 84 to limit of travel of the armature in the assembly.

The pole assembly 94 is received in the closed end portion 96 of sleeve 68. The pole assembly includes the cylindrical pole piece 98, shading ring 100 which is mounted on a reduced diameter portion 102 of pole piece 98, and the surrounding, concentric flux ring 104 which is press-fitted into annular shoulder 106 of the pole piece 98. The pole piece 98 has an annular groove 108 that receives an inwardly-formed annular bead 110 of sleeve 68, thereby fixedly securing the pole assembly in place. The inwardly directed face of pole piece 98 has an arcuate concavity 112 and receives the arcuately convex end 114 of armature 24.

As shown in FIG. 3, the arcuately convex face 114 of armature 24 has a slightly greater radius of curvature than the arcuately concave base 112 of pole piece 94 whereby the moveable armature 24 mates against the face 112 of stationary pole piece 94 in a ring line contact 115.

The coil 116 of the solenoid is formed on spool 118 and is received in the annulus between sleeve 68 and casing 26 with a potting compound 121 cementing the coil in place. The terminal posts 34 and 36 have web bases such as 35 which are secured in electrical contact with the conductor 37 of coil 116. A terminal insulator ring 120 is mounted on the end of spool 118 and this ring has tubular projections 122 and 124 that surround the projecting terminal posts 34 and 36, respectively. The ring 120 has a central aperture 126 through which the end 127 of sleeve 68 projects, resiliently biased against the opposed face of closure plate 32.

Referring now to FIG. 4, the pole assembly 94 is illustrated in an exploded view. As there illustrated, the pole piece 98 is a generally cylindrical plug having an annular, central raised rim 106 and a distal, raised rim 107 which form therebetween annular groove 108. The opposite end 102 is received within shading ring 100 which, together with the pole piece 98, is received within flux ring 104.

Referring now to FIG. 2, the annular air gap 128 between the end of flux ring 104 and the opposed annular edge of the convex face 114 of armature 24 is of critical dimensions to the proper functioning of the solenoid. This air gap regulates the flux density of the residual magnetic field that serves to hold the armature against the resilient bias of spring 44 during the transitory inflections of the supply voltage through zero voltage. As previously mentioned, prior constructions have required precise machining of the opposed faces of the stationary pole and moveable armature to achieve the close tolerances necessary for the proper dimensioning of air gap 128.

FIG. 5 illustrates the assembly method of this invention which provides for the facile calibration of the pole piece. As there illustrated, the pole assembly 94 is placed between a moveable platen 130 and a stationary anvil 132 of a press. Anvil 132 has a central, arcuately-convex, raised boss 134 of a radius substantially equal to the radius of curvature of the arcuately concavity 112 of the pole piece 98. The annular shoulder 136 of anvil 132 is at a precise elevation relative to the convex face of boss 134 such that compression of the pole assembly 94 in the illustrated manner will advance the flux ring 104 onto the annular rim 106 of the pole piece 98 to precisely the proper axial orientation desired for the air gap 128.

Referring now to FIGS. 6–11, the method of assembly of the solenoid will be described. As illustrated in FIG. 6, the pole assembly 94 is placed into the closed end portion 96 of the sleeve 68. The closed end portion 96 is of reduced diameter and closely surrounds the received end of the pole assembly. As shown in FIG. 7, the closed end portion 96 of sleeve 68 is inwardly deformed to provide an inwardly-directed, annular bead 110 which is received in the annular groove 108 of the pole assembly 94.

Referring now to FIG. 8, the casing 26 is fitted with the annular bushing 84. Referring to FIG. 9, the resultant subassembly then receives the subassembly of sleeve 68 and pole piece 94. The annular washer seal 76 is first placed in the casing 26 and the sleeve 68 is placed into the casing with its annular flange 70 pressed into the reduced diameter portion 72 of casing 26. The edge of flange 72 has a raised rim 74 that is firmly seated in casing 26. The sleeve 68 is pressed into the casing by a press or moveable platen 138 that advances against a stationary anvil 140 having a central aperture 142 that receives the raised circular end wall 82 and associated bushing 84 of the casing subassembly. The platen 138 has a sufficient span to contact the annular lip 54 on the open end of casing 26, which serves as an abutment or stop restricting further axial advance of the platen 138.

Referring now to FIG. 10, the release of platen 138 permits the axially-resilient retainer sleeve 68 to spring back a slight distance 144. The axial resiliency of sleeve 68 is imparted to this member by the formation of the annular bead 110 of the reduced diameter end portion 96 which accommodates a slight flexing movement of this member. This axial compressibility of the retainer sleeve insures that its closed face 127 will be biased against the opposing face of the closure plate 32 as apparent from FIG. 2.

The remainder of the assembly of the solenoid is illustrated in FIG. 11. As there illustrated, the moveable armature 24 is assembled with valve face plate 21, valve facing 23, retainer ring 62 and the circlip 64. The clip ring 92 is placed in groove 90 of armature 24 and coil spring 44 is placed about the subassembly which is then pressed into the retainer sleeve 68, the clip ring 92 deforming as necessary to be received through bushing 84.

Potting compound is then poured into the annular cavity 146 between casing 26 and retainer sleeve 68 and the coil 116 is inserted. Prior to inserting coil 116, the terminal posts 34 and 36 are mounted on the coil with their web bases such as 35 received in radial tracks 33 on the end face 31 of coil spool 118.

The assembly is then completed by placing the annular seal ring 50 about casing 26, followed by the threaded sleeve 28 which is advanced to the annular flange 54 of casing 26.

The insulator ring 120 is placed over the coil with the tubular members 122 and 124 receiving the terminal posts 34 and 36 and the cover plate 56 is placed over the insulator ring 120 and is received within the open end of the threaded sleeve 28. The edge 30 of threaded sleeve 28 is then rolled about the perimeter of cover plate 56 to complete the assembly.

The invention has been described with reference to the illustrated and presently preferred embodiment thereof. It is not intended that the invention be unduly restricted by this illustration and description of the presently preferred embodiment. Instead, it is intended that the invention be defined by the means, and their obvious equivalents, set forth in the following claims.

What is claimed is:

1. A pole piece and retainer sleeve assembly for a solenoid comprising:

(a) a cylindrical sleeve for mounting within a coil of a solenoid assembly;

(b) a stationary pole assembly received therein comprising (1) a pole piece having an arcuately concave end and a central, raised annular rim;

(2) a shading ring distally carried thereon;

(3) a flux ring press-fitted on said central raised annular rim and projecting past said concave end to a precise axial position thereon; and (c) a moveable armature slidably received within said cylindrical sleeve and having an arcuately convex end opposed to said arcuately concave end of said pole piece and having a greater radius of curvature to mate therewith in a circular line contact about its periphery and at a precise axial spaced-apart position from said flux ring.

2. The assembly of claim 1 wherein said pole piece has an annular groove and said retainer sleeve has an inwardly deformed wall thereabout to form an annular, inward bead seated within said annular groove fixedly securing said pole piece in said assembly.

3. The pole piece and retainer sleeve assembly of claim 1 in further assembly with a cylindrical solenoid casing with an annular sheet flange distally carried on said retainer sleeve and received within a reduced diameter end of said casing in a press-fit.

4. The assembly of claim 3 in further assembly with an annular coil received in the annular cavity between said retainer sleeve and said casing.

5. The assembly of claim 4 further including an end closure plate with retainer means of said casing having a roll edge about the periphery of said closure plate to complete said assembly.

6. The assembly of claim 5 wherein said retainer sleeve has a relaxed position extending slightly axially past the end of said casing whereby the end of said retainer sleeve resiliently biases against said closure plate.

* * * * *